US009186916B1

(12) United States Patent
Ishihara et al.

(10) Patent No.: US 9,186,916 B1
(45) Date of Patent: Nov. 17, 2015

(54) DRYING DEVICE, IMAGE FORMING APPARATUS, AND COMPUTER READABLE MEDIUM STORING PROGRAM

(71) Applicant: FUJI XEROX CO., LTD., Tokyo (JP)

(72) Inventors: Takuma Ishihara, Kanagawa (JP); Yukari Motosugi, Kanagawa (JP); Takeshi Zengo, Kanagawa (JP); Jun Isozaki, Kanagawa (JP); Akira Sakamoto, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 14/690,626

(22) Filed: Apr. 20, 2015

(30) Foreign Application Priority Data

Dec. 16, 2014 (JP) ..... 2014-254186

(51) Int. Cl.
*B41J 2/01* (2006.01)
*B41J 11/00* (2006.01)
*B41M 7/00* (2006.01)

(52) U.S. Cl.
CPC ..... *B41J 11/002* (2013.01); *B41M 7/0045* (2013.01); *B41M 7/009* (2013.01); *B41M 7/0054* (2013.01); *B41M 7/0081* (2013.01)

(58) Field of Classification Search
None
See application file for complete search history.

(56) References Cited

U.S. PATENT DOCUMENTS 8,240,841 B2 * 8/2012 Caracciolo et al. ..... 347/102

FOREIGN PATENT DOCUMENTS

JP 2014-083762 5/2014

* cited by examiner

*Primary Examiner* — Lisa M Solomon
(74) *Attorney, Agent, or Firm* — Fildes & Outland, P.C.

(57) ABSTRACT

A drying device includes: a drying unit in which a plurality of laser light sources are arranged two-dimensionally and that dries ink placed on a recording medium by ejecting ink droplets from an ejecting unit by irradiating the ink with laser light; a measuring unit that measures a temperature characteristic, in a conveying direction of the recording medium, of the ink placed on the recording medium; a generation unit that generates, based on the temperature characteristic, a laser light irradiation profile with which the ink temperature will be raised by irradiation with laser light to become higher than or equal to a flex temperature at which the ink temperature starts to flex and then kept in a range being higher than or equal to the flex temperature and lower than a boiling temperature or the ink; and a control unit that controls the drying unit using the irradiation profile.

10 Claims, 12 Drawing Sheets

SHEET CONVEYING DIRECTION

| | | | | | | | | | | | |
|---|---|---|---|---|---|---|---|---|---|---|---|
| 3.5 | 3.5 | 3.5 | 2.5 | 2.25 | 1.75 | 1.5 | 1.5 | 1.75 | 1.75 | 1.5 | ··· |
| 3.5 | 3.5 | 3.5 | 2.5 | 2.25 | 1.75 | 1.5 | 1.5 | 1.75 | 1.75 | 1.5 | ··· |
| 3.5 | 3.5 | 3.5 | 2.5 | 2.25 | 1.75 | 1.5 | 1.5 | 1.75 | 1.75 | 1.5 | ··· |
| 3.5 | 3.5 | 3.5 | 2.5 | 2.25 | 1.75 | 1.5 | 1.5 | 1.75 | 1.75 | 1.5 | ··· |
| 3.5 | 3.5 | 3.5 | 2.5 | 2.25 | 1.75 | 1.5 | 1.5 | 1.75 | 1.75 | 1.5 | ··· |
| 3.5 | 3.5 | 3.5 | 2.5 | 2.25 | 1.75 | 1.5 | 1.5 | 1.75 | 1.75 | 1.5 | ··· |
| 3.5 | 3.5 | 3.5 | 2.5 | 2.25 | 1.75 | 1.5 | 1.5 | 1.75 | 1.75 | 1.5 | ··· |
| 3.5 | 3.5 | 3.5 | 2.5 | 2.25 | 1.75 | 1.5 | 1.5 | 1.75 | 1.75 | 1.5 | ··· |
| ⋮ | ⋮ | ⋮ | ⋮ | ⋮ | ⋮ | ⋮ | ⋮ | ⋮ | ⋮ | ⋮ | ⋮ |
| 3.5 | 3.5 | 3.5 | 2.5 | 2.25 | 1.75 | 1.5 | 1.5 | 1.75 | 1.75 | 1.5 | ··· |

DRYING DEVICE, IMAGE FORMING APPARATUS, AND COMPUTER READABLE MEDIUM STORING PROGRAM

CROSS-REFERENCE TO RELATED APPLICATIONS

This application is based on and claims priority under 35 USC 119 from Japanese Patent Application No. 2014-254186 filed on Dec. 16, 2014.

BACKGROUND

Technical Field

The present invention relates to a drying device, an image forming apparatus, and a computer readable medium storing a program.

SUMMARY

According to an aspect of the invention, there is provided a drying device comprising: a drying unit in which plural laser light sources are arranged two-dimensionally and that dries ink placed on a recording medium as a result of ejecting of ink droplets from an ejecting unit by irradiating the ink with laser light; a measuring unit that measures a temperature characteristic, in a conveying direction of the recording medium, of the ink placed on the recording medium; a generation unit that generates, on the basis of the temperature characteristic measured by the measuring unit, a laser light irradiation profile with which the ink temperature will be raised by irradiation with laser light to become higher than or equal to a flex temperature at which the ink temperature starts to flex and then kept in a range that is higher than or equal to the flex temperature and lower than a boiling temperature of the ink; and a control unit that controls the drying unit using the irradiation profile generated by the generation unit.

BRIEF DESCRIPTION OF THE DRAWINGS

Exemplary embodiments of the present invention will be described in detail based on the following figures, wherein.

DESCRIPTION OF SYMBOLS

Figure 1:
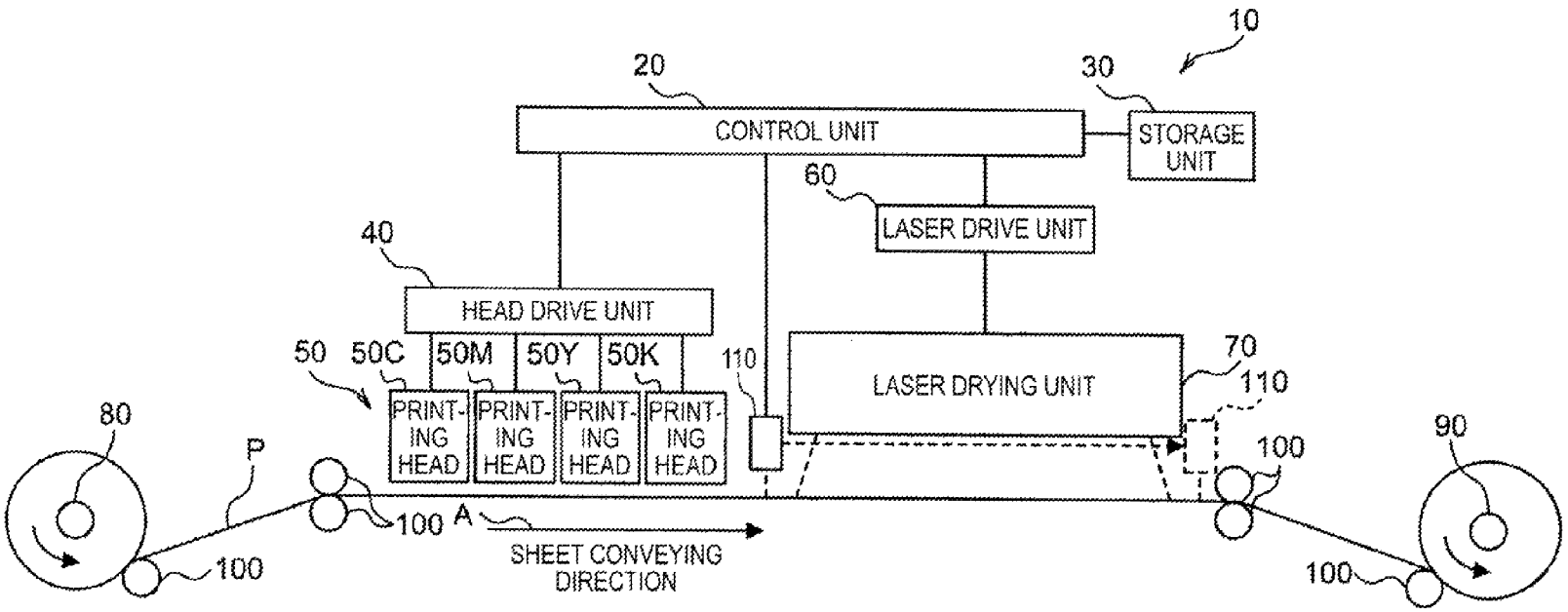
FIG. 1 schematically shows an essential configuration of an inkjet recording apparatus according to a first exemplary embodiment.

10: Image forming apparatus
20: Control unit
50: Printing head
70: Laser drive unit
72A-72D: Laser drying units
74: VCSEL array
110: Temperature sensor
P: Continuous sheet

DETAILED DESCRIPTION

Exemplary embodiments of the present invention will be hereinafter described in detail with reference to the drawings. These exemplary embodiments are directed to a case that the invention is applied to an inkjet recording apparatus which record an image by ejecting ink droplets to a recording medium.

[Exemplary Embodiment 1 ]

First, the configuration of an inkjet recording apparatus 10 according to a first exemplary embodiment will be described. As shown in FIG. 1, the inkjet recording apparatus 10 according to this exemplary embodiment is equipped with a control unit 20, a storage unit 30, a head drive unit 40, printing heads 50, a laser drive unit 60, a laser drying device 70, a supply roll 80, a take-up roll 90, conveying rollers 100, and a temperature sensor 110.

Figure 3:
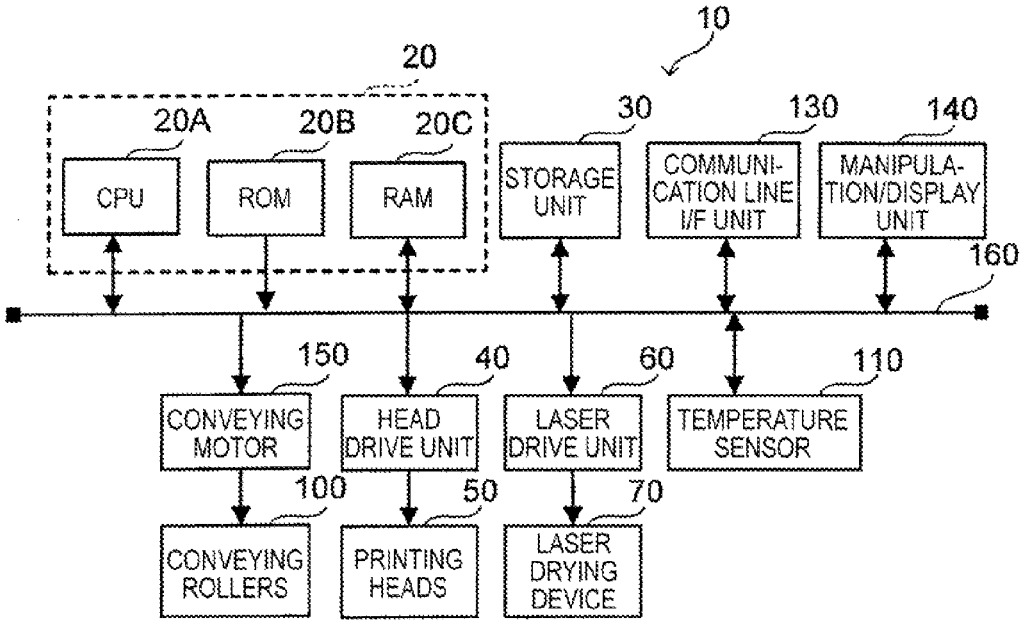
FIG. 3 is a block diagram showing an essential electrical configuration of the inkjet recording apparatus according to the first exemplary embodiment.

The control unit 20 controls the rotation of the conveying rollers 100 which are connected to a conveying motor 150 see FIG. 3) by such a mechanism as gears by driving the conveying motor 150. A long, continuous sheet P (recording medium) is wound on the supply roll 80 and is conveyed in a conveying direction A shown in FIG. 1 as the conveying rollers 100 are rotated. In the following description, the direction in which the continuous sheet P is conveyed (i.e., the direction A shown in FIG. 1) will be referred simply as a "conveying direction."

The storage unit 30 is a nonvolatile storage unit such as an HDD (hard disk drive). The control unit 20 acquires image information that is stored in the storage unit 30 and a user wants to be printed on the continuous sheet S, that is, user image information, and controls the head drive unit 40 on the basis of pixel-by-pixel color information included in the user image information. The head drive unit 40 drives the printing heads 50 connected to it according to ink droplets ejecting timing commanded by the control unit 20, and thereby causes the printing heads 50 connected to the head drive unit 40 to eject ink droplets onto the continuous sheet P being conveyed. As a result, an image corresponding to the user image information is formed on the continuous sheet P being conveyed. In the following description, an image that is formed on the continuous sheet P according to user image information will be referred to as a user image.

Color information of each pixel of a user image includes information indicating a color of the pixel uniquely. Although in the exemplary embodiment the color information of each pixel of a user image is represented by densities of, for example, yellow (Y), magenta (M), cyan (C), and black (K), any of other representation methods capable of representing a color of each pixel of a user image uniquely may be used.

The printing heads 50 are four printing heads 50Y, 50M, 50C, and 50K Which correspond to the four respective colors Y, M, C, and K, and each printing head 50 ejects ink droplets of a corresponding color from its ink ejecting outlet. There are no limitations on the drive method for causing each printing head 50 to eject ink droplets; any of known drive methods such as a thermal method and a piezoelectric method may be employed.

Whereas there are various kinds of inks such as water-based inks, solvent inks (i.e., inks containing a solvent that evaporates), and ultraviolet-curing inks, the exemplary embodiment employs water-based inks as an example. In the following description, when the term "ink" or "ink droplets" is used alone, it means a water-based ink or water-based ink droplets. The Y, M, C, and K inks used in the exemplary embodiment are added with an IR 8infrared) absorbent and their degrees of laser light absorption are thereby adjusted, the invention is not limited to such a case. For example, an ink that absorbs laser light, such as a K ink, need not be added with an IR absorbent.

The laser drive unit 60 is equipped with switching elements such as FETs (field-effect transistors) for on/off-controlling laser elements included in the laser drying device 70. The laser drive unit 60 adjusts the irradiation intensity (irradiation energy) of laser light emitted from each laser element by controlling the pulse duty ratio by driving the corresponding switching element under the control of the control unit 20.

By controlling the head drive unit 40, the control unit 20 causes the laser drying device 70 to irradiate, with laser light, the surface on which an image is being formed of the continuous sheet P and thereby fixes a user image to the continuous sheet P by drying inks formed on thereon. In the following description, the surface on which an image is being formed of the continuous sheet P will be referred to as an "image forming surface." The continuous sheet P is thereafter conveyed to and taken up by the take-up roller 90 as the conveying rollers 100 are rotated.

The temperature sensor 110 is a senor such as a radiation thermometer for measuring a surface temperature of inks by a noncontact method. Driven by a motor or the like (not shown) under the control of the control unit 20, the temperature sensor 110 is moved in the conveying direction at the same speed as the continuous sheet P. Therefore, temperatures of inks formed on the continuous sheet P are measured at different positions in the conveying direction. That is, a temperature characteristic as a time-series variation of ink temperature (hereinafter referred to simply as a "temperature characteristic") is measured by the temperature sensor 110.

Figure 2:
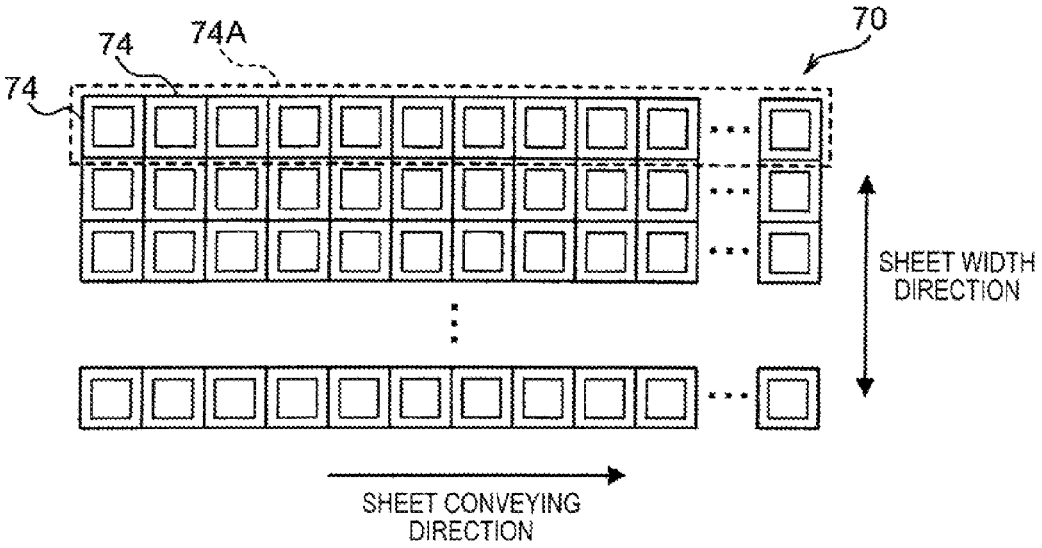
FIG. 2 is a schematic plan view showing an example configuration of a laser drying device used in the first exemplary embodiment.

Next, the configuration of the laser drying device 70 employed in the exemplary embodiment will be described in detail. As shown in FIG. 2, the laser drying device 70 employed in the exemplary embodiment is equipped with plural VCSEL (vertical cavity surface-emitting laser) arrays 74 that are arranged two-dimensionally, more specifically, in lattice form in the conveying direction and the width direction of the continuous sheet P which is perpendicular to the conveying direction. In the following description, the direction of the continuous sheet P will be referred simply as a "width direction." The VCSEL arrays 74 are an example of laser light sources employed in the invention.

Each VCSEL array 74 is equipped with plural VCSELs (not shown). In the laser drying device 70 employed in the exemplary embodiment, the laser light emission timing and the laser light irradiation intensity are controlled for each VCSEL array 74 by the laser drive unit 60. This unit of driving of the laser drive unit 60 is just an example; for example, the laser drive unit 60 may control the laser light emission timing and the laser light irradiation intensity in units of a VCSEL array group 74A including plural VCSEL arrays 74 that are arranged in line in the conveying direction (indicated by a broken-line rectangle in FIG. 2).

Next, an essential electrical configuration of the inkjet recording apparatus 10 according to the exemplary embodiment will be described with reference to FIG. 3. As shown in FIG. 3, the control unit 20 of the inkjet recording apparatus 10 according to the exemplary embodiment is equipped with a CPU 20A which supervises the overall inkjet recording apparatus 10 and a ROM (read-only memory) 20B which is stored in advance with various kinds of programs, various kinds of parameters, etc. The control unit 20 is also equipped with a RAM (random access memory) 20C which serves as a working area or the like when the CPU 20A runs various kinds of programs.

The inkjet recording apparatus 10 is also equipped with a communication line interface (I/F) unit 130 for exchange of communication data with an external device, and a manipulation/display unit 140 which receives a user instruction to the inkjet recording apparatus 10 and gives a user various kinds of information relating to an operation status etc. of the inkjet recording apparatus 10. For example, the manipulation/display unit 140 includes a touch-screen display on which various kinds of information and buttons for reception of a manipulation instruction are displayed as a result of execution of programs, hardware keys such as a ten-key unit and a start button, and other things.

The CPU 20A, the ROM 20B, the RAM 20C, the storage unit 30, the head drive unit 40, the laser drive unit 60, the temperature sensor 110, the communication line I/F unit 130, the manipulation/display unit 140, and the conveying motor 150 are connected to each other by a bus 160 consisting of an address bus, a data bus, a control bus, etc. The printing heads 50 are connected to the head drive unit 40, the laser drying device 70 is connected to the head drive unit 40, and the conveying rollers are connected to the conveying motor 150.

With the above electrical system configuration, the CPU 20A controls the head drive unit 40 via the bus 160 and thereby causes it to drive the printing heads 50 in the above-described manner. The CPU 20A controls the laser drive unit 60 via the bus 160 and thereby causes it to control laser light irradiation by the laser drying device 70 in the above-described manner. Furthermore, the CPU 20A controls the conveying motor 150 via the bus 160 and thereby causes it to control the rotation of the conveying rollers 100 in the above-described manner.

Still further, the CPU 20A controls movement of the temperature sensor 110 in the conveying direction via the bus 160 and acquires ink temperatures measured by the temperature sensor 110.

Incidentally, in the inkjet recording apparatus 10 according to the exemplary embodiment, inks placed on the continuous sheet P as a result of ejecting of ink droplets onto the continuous sheet P from the printing heads 50 are required to be dried quickly. It is therefore conceivable to cause the laser drying device 70 to shine laser light at an upper limit irradiation intensity. However, if the laser light irradiation intensity is too high, the optical densities of an image contrary to the intention. One reason for this phenomenon is that the temperature of inks becomes higher than their boiling temperature and parts of the inks boil to scatter. In the following description, when the term "boiling temperature" is used alone, it means a boiling temperature of inks. If the term "irradiation intensity" is used alone, it means irradiation intensity of laser light. Where water-based inks are used as in the exemplary embodiment, the boiling temperature of inks placed on a sheet is about 100° C. though it varies depending the air pressure etc. at a place of installation of an ink jet recording apparatus.

Furthermore, if the laser light irradiation intensity is too high, the degree of fixing of inks to the continuous sheet P lowers because the temperature of the inks becomes higher than their boiling temperature and parts of the inks boil to scatter. On the other hand, if the laser light irradiation intensity is too low, the water of the inks does not evaporate sufficiently and part of it remains, which means a low degree of fixing of the inks to the continuous sheet P.

Therefore, shining laser light so that the ink temperature is kept within such a range as to be lower than the boiling temperature but as close to it as possible leads to suppression of image quality degradation as well as results in energy saving because highest ink drying efficiency.

Figure 4A:
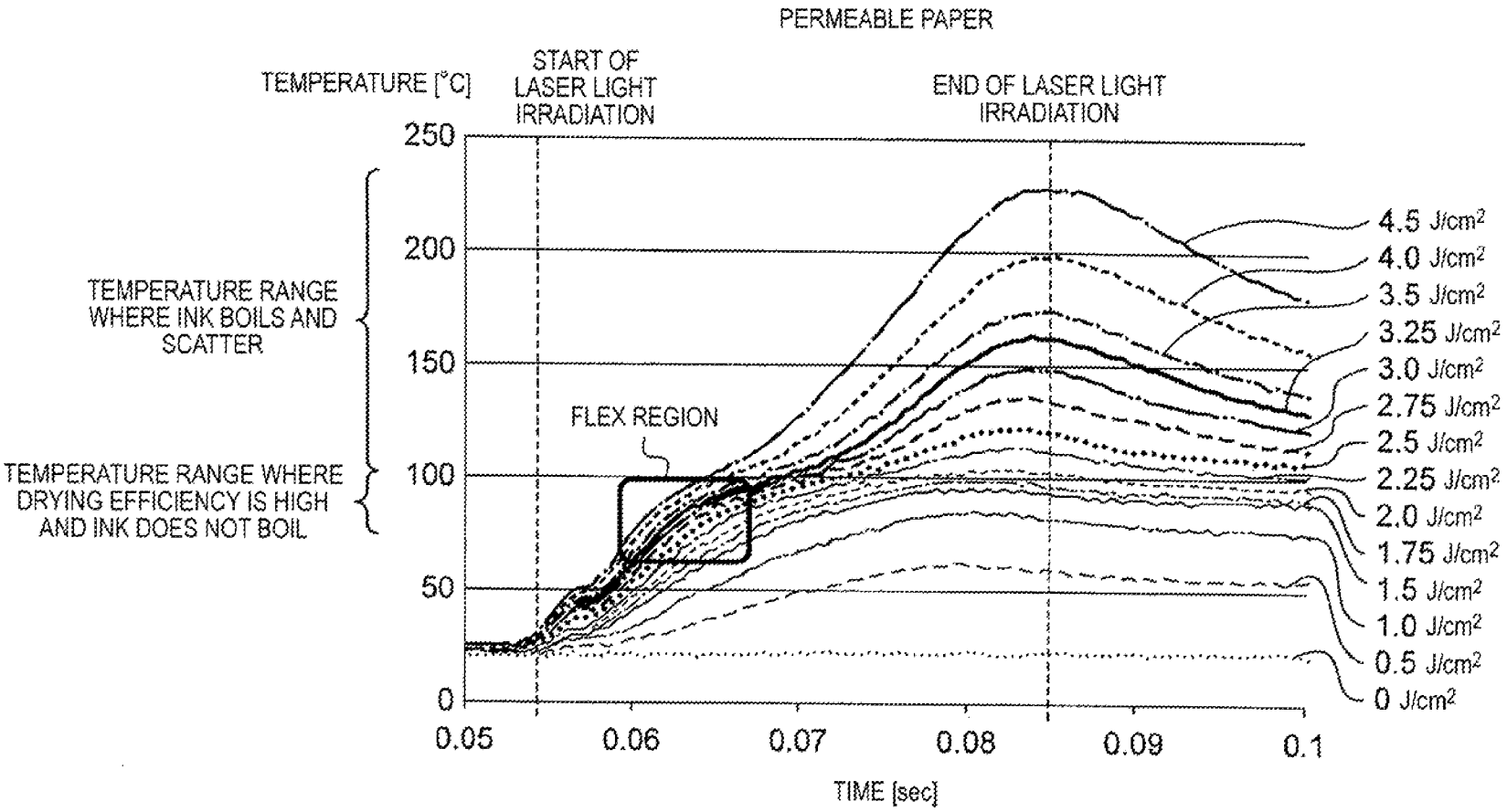
FIG. 4A is a graph showing example time-series variations of ink temperature that were obtained when ink placed on permeable paper as a result of ejecting of ink droplets was irradiated with laser light.
Figure 4B:
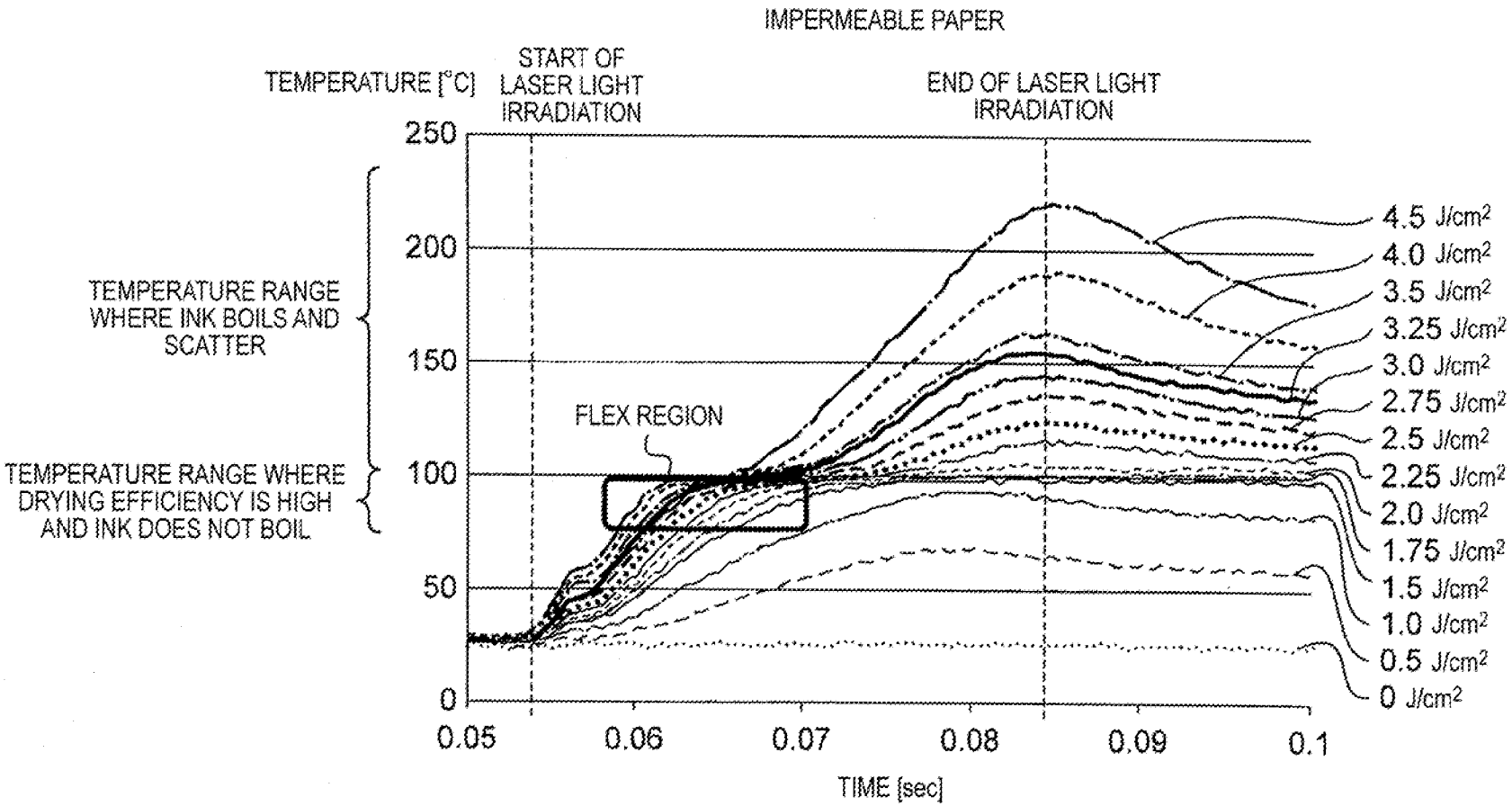
FIG. 4B is a graph showing example time-series variations of ink temperature that were obtained when ink placed on impermeable paper in the same manner was irradiated with laser light.

Incidentally, ink temperature characteristics shown in FIGS. 4A and 4B were obtained experimentally by performing laser light irradiation in an actual machine of the inkjet recording apparatus 10 according to the exemplary embodiment. FIG. 4A shows ink temperature characteristics of permeable paper such as plain paper into which ink droplets permeate, and FIG. 4B shows ink temperature characteristics of impermeable paper such as coat paper into which ink droplets do not permeate.

In FIGS. 4A and 48, the vertical axis represents the ink temperature (°C.) and the horizontal axis represents the elapsed time (s) from ejecting of ink droplets. The left-hand and right-hand vertical broken lines indicate the start and end, respectively, of each laser light irradiation period. In each of FIGS. 4A and 4B, curves represent ink temperature characteristics of a case without laser light irradiation (i.e., the laser light irradiation intensity was 0 (J/cm$^2$)) and cases that the laser light irradiation intensity was 0.5 to 4.5 (J/cm$^2$).

The ink temperature increases approximately linearly after the start of laser light irradiation and the rate of increase (i.e., the increase per unit time) starts to decrease in the vicinity of a boiling temperature, that is, flexing occurs there (a flex region is enclosed by a rectangle in each of FIGS. 4A and 4B) . In the following, the temperature at which the ink temperature starts to flex will be referred to as a "flex temperature." In the exemplary embodiment, the flex temperature is defined as a temperature that is higher than or equal to a boiling temperature minus a predetermined temperature (e.g., 20°C.) and lower than the boiling temperature and at which the rate of increase of ink temperature has dropped by a predetermined percentage (e.g., 20%). The inkjet recording apparatus 10 may be configured so that the predetermined temperature and the predetermined percentage can be set by a user through the manipulation/display unit 140.

The flex temperature, the time from a start of laser light irradiation to a time when the ink temperature reaches the flex temperature, and the time from the time when the ink temperature reaches the flex temperature to a time when the ink temperature reaches a boiling temperature vary depend on the ink type, the continuous sheet type, the temperature and degradations with age of the VCSEL arrays 74, and other factors. In view of this, in the inkjet recording apparatus 10 according to the exemplary embodiment, ink temperature characteristics as shown in Figs- 4A and 4B are obtained by measuring temperatures of inks being irradiated with laser light and profile generation processing is performed that generates an irradiation profile with which by laser light irradiation the ink temperature will be increased to a temperature higher than or equal to a flex temperature and then kept higher than or equal to the flex temperature and lower than a boiling temperature.

Next, a description will be made of the workings of the inkjet recording apparatus 10 according to the exemplary embodiment. First, a profile generation process according to the exemplary embodiment will be described with reference to FIG. 5, which is a flowchart showing the procedure of a profile generation program that is run by the CPU 20A upon ink type switching. This program is installed in the ROM 20B in advance. Although in the exemplary embodiment the profile generation program is run upon ink type switching, the invention is not limited to such a case. The profile generation program may be run with other timing, for example, upon continuous sheet switching or carrying-out of maintenance work.

Figure 5:
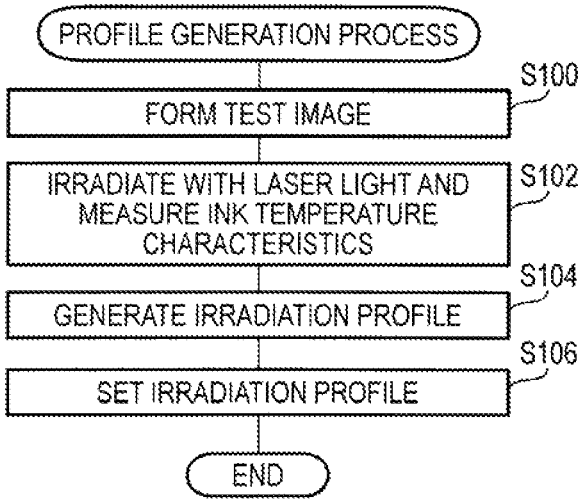
FIG. 5 is a flowchart showing the procedure of a profile generation program according to the first exemplary embodiment.

At step S100 shown in FIG. 5, the CPU 20A forms a test image having a predetermined size in a region of a continuous sheet P to be irradiated with laser light emitted from the laser drying device 70. More specifically, in the exemplary embodiment, the CPU 20A forms, for example, a 10-mm-square, K-color test image having a 100% density.

Figure 6:
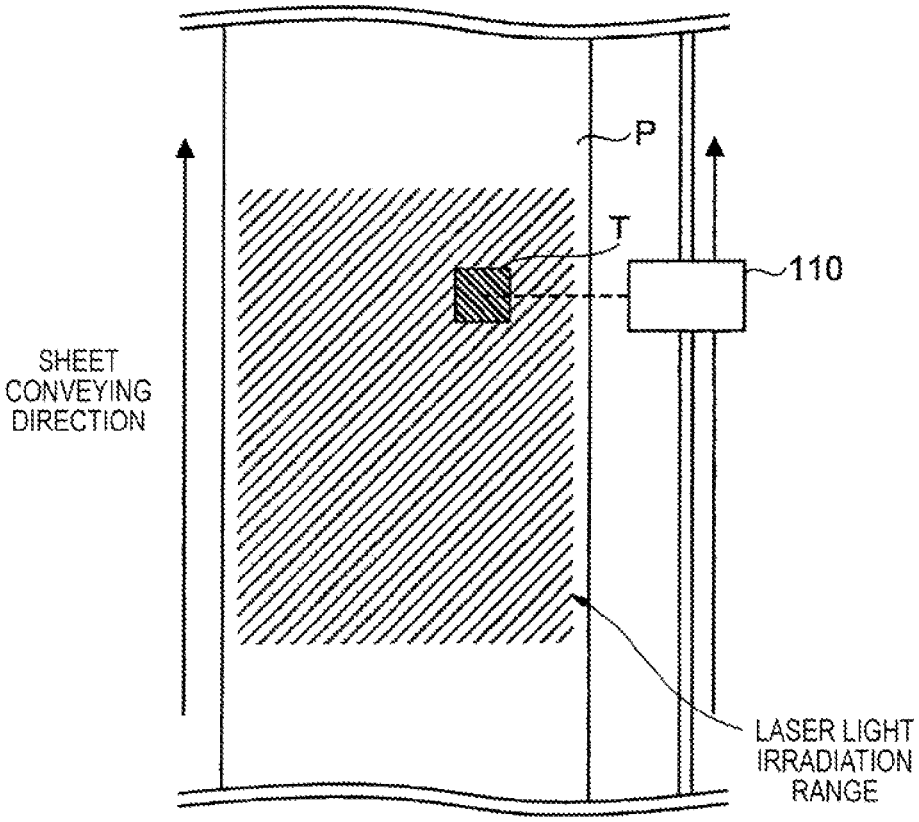
FIG. 6 is a schematic plan view for description of a profile generation process according to the first exemplary embodiment.

At step S102, the CPU 20A causes the laser drying device 70 to irradiate the test image with laser light in such a manner that VCSEL array groups 74A in a region corresponding to the test image forming region emit laser light at different irradiation intensities. At the same time, the CPU 20A causes the temperature sensor 110 to measure ink temperatures for each of the unit regions corresponding to the respective different irradiation intensity values while moving the temperature sensor 110 in the conveying direction at the same speed as the conveying speed of the continuous sheet P, and stores measurement results in the storage unit 30. The CPU 20A acquires ink temperature characteristics as shown in FIGS. 4A and 4B as a result of execution of step S102, and stores them in the storage unit 30. As a result of execution of steps S100 and S102, a test image T is irradiated with laser light and ink temperature characteristics are measured by the temperature sensor 110 in a manner shown in FIG. 6.

At step S104, the CPU 20A generates an irradiation profile on the basis of the ink temperature characteristics acquire by the execution of step S102. More specifically, the CPU 20A calculates rates of ink temperature increases (i.e., increases per unit time) caused by the laser light irradiation at the respective irradiation intensities using slopes of straight lines obtained by approximating portions, from starts of temperature increases (due to laser light irradiation) to times when the ink temperatures reach flex temperatures, of curves representing the ink temperature characteristics corresponding to the respective irradiation intensity values. Then the CPU 20A generates an irradiation profile by determining an irradiation intensity with which the ink temperature will be kept higher than or equal to a flex temperature and lower than a boiling temperature on the basis of the ink temperature increase rates corresponding to the respective irradiation intensity values. Alternatively, the CPU 20A may calculate an ink temperature increase rate using the slope of a tangential line to a curve representing each ink temperature characteristic at a boiling temperature or a temperature immediately under the boiling temperature.

At step S106, the CPU 20A sets, for respective VCSEL arrays 104, irradiation intensity values corresponding to the irradiation profile generated at step S106. The profile generation program is then finished.

When a user image is thereafter formed, the user image is irradiated with laser light on the basis of the irradiation intensity values that are set for the respective VCSEL arrays 104 as a result of the running of the above-described profile generation program.

Figures 7, 8:
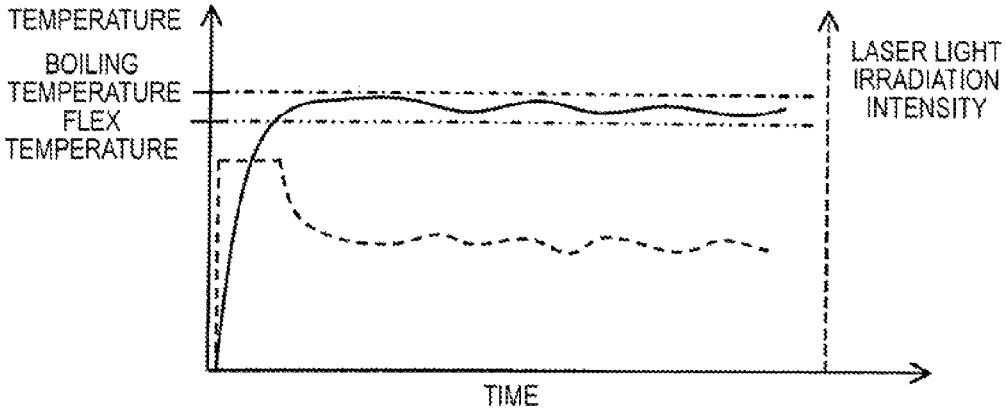
FIG. 7 is a graph showing an example irradiation profile generated according to the first exemplary embodiment.
FIG. 8 is a table showing example laser light, irradiation intensity values of the irradiation profile shown in FIG. 7.

Referring to FIGS. 7 and 8, a description will be made of an irradiation profile generated by running the above-described profile generation program and an ink temperature variation that is obtained when inks are dried using the thus-generated irradiation profile. In FIG. 7, the broken-line curve, which corresponds to the right-hand vertical axis, represents a variation of laser light irradiation intensity and the solid-line curve, which corresponds to the left-hand vertical axis, represents a variation of ink temperature. The horizontal axis of FIG. 7 represents the elapsed time from ejecting of ink droplets. In FIG. 7, the chain line and the two-dot chain line indicate a boiling temperature and a flex temperature, respectively. In FIG. 8, each box corresponds to one VCSELL cell array 74 and the numerical value shown in each box is a laser light irradiation intensity (J/cm$^2$) of the corresponding VCSELL cell array 74. In FIG. 8, the horizontal axis and the vertical axis correspond to the conveying direction and the width direction, respectively.

As exemplified in FIGS. 7 and 8, with an irradiation profile generated according to the exemplary embodiment, first, inks are irradiated with laser light having a large irradiation intensity. Then the laser light irradiation intensity decreases gradually and thereafter varies in a certain range. As a result, as shown in FIG. 7, the ink temperature increases steeply to close, to the boiling temperature approximately linearly and thereafter kept within a certain range, that is, kept higher than or equal to a flex temperature and lower than the boiling temperature.

Figure 9:
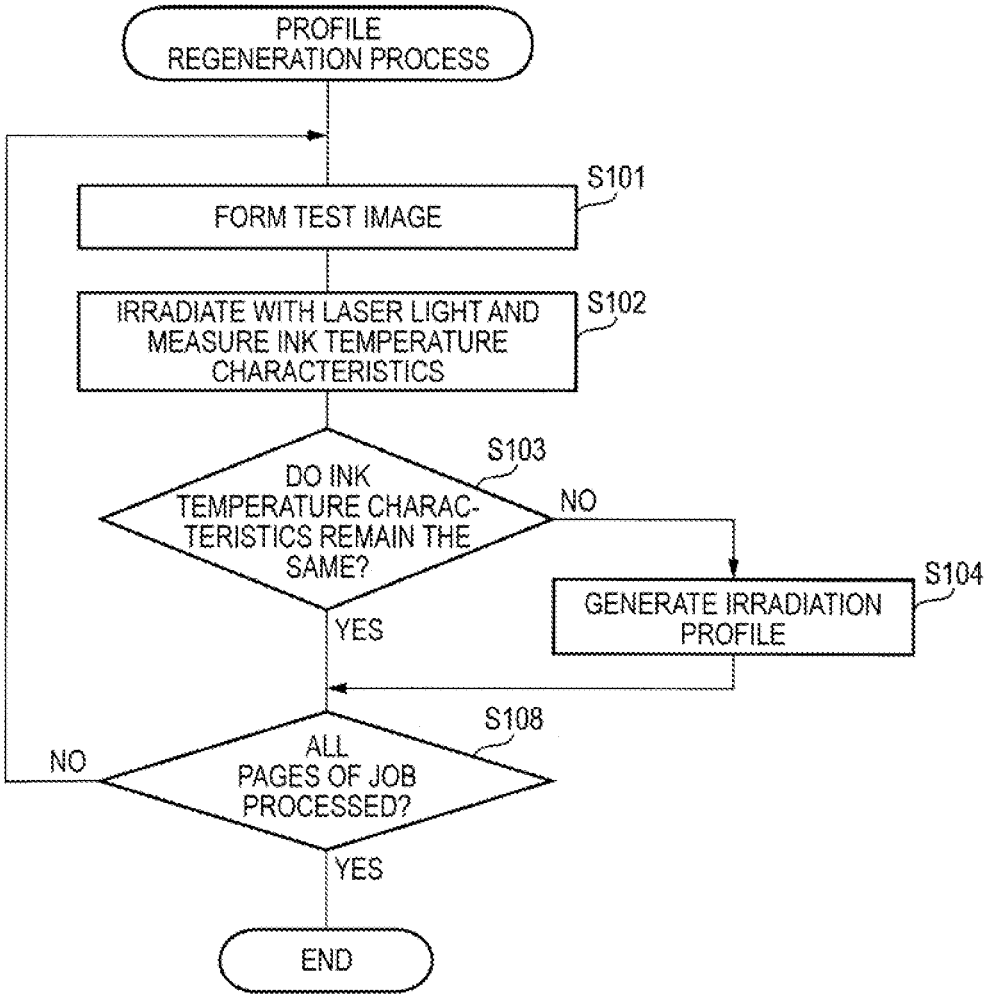
FIG. 9 is a flowchart showing the procedure of a profile regeneration program according to the first exemplary embodiment.

Next, a profile regeneration process according to the exemplary embodiment will be described with reference to FIG. 9. FIG. 9 is a flowchart showing the procedure of a profile regeneration program that is executed by the CPU 20A when the inkjet recording apparatus 10 receives an instruction to carry out a print job for formation of images of plural pages on a continuous sheet P. This program is installed in the ROM 20B in advance. To avoid making the description unduly complicated, steps for formation of a user image will not be described. Steps in FIG. 9 having the same ones in FIG. 5 are given the same step numbers as the latter, and descriptions therefor will be omitted.

Figure 10:
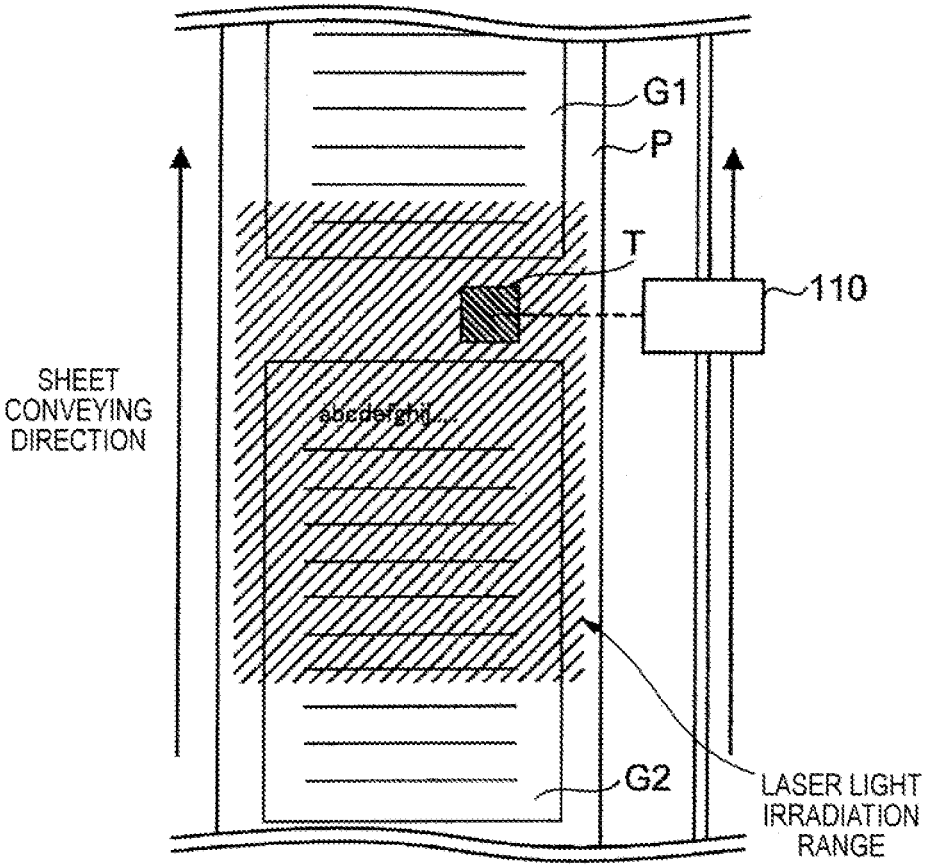
FIG. 10 is a schematic plan view for description of a profile regeneration process according to the first exemplary embodiment.

At step S101 shown in FIG. 9, the CPU 20A forms a test image T in each region of a continuous sheet P that is located between adjoining pages and is to be irradiated with laser light emitted from the laser drying device 70. As a result of execution of step S101 and step S102 (described above with reference to FIG. 5) , as shown in FIG. 10 the test image T formed between pages G1 and G2 is irradiated with laser light and ink temperature variations are measured by the temperature sensor 110.

At step S103, the CPU 20A judges whether or not ink temperature characteristics acquired by step S102 this time remain the same as the ones that were acquired when an irradiation profile was generated previously and are stored in the storage unit 30. More specifically, for example, the CPU 20A makes an affirmative judgment if the slope of a straight line that approximates a curve along which the ink temperature increases to the flex temperature after a start of laser light irradiation (see FIGS. 4A and 4B) is the same as the previous slope. The criterion for the judgment as to whether or not the ink temperature characteristics remain the same is not limited to the above; the CPU 20A may make an affirmative judgment if a slope difference is within a range that is predetermined as a range of no ink temperature characteristic variation. As a further alternative, the CPU 20A may judge whether or not the ink temperature characteristics remain the same on the basis of a change of the secondary coefficient of a quadratic curve that approximates an ink temperature characteristic curve. The CPU 20A moves to step S103 if the judgment result of step S103 is affirmative, and to step S104 if it is negative.

At step S108, the CPU 20A judges whether all of the pages of the print job have been processed. The CPU 20A returns to step S100 if the judgment result of step S108 is negative, and finishes the profile regeneration program if it is affirmative.

When irradiation profiles are regenerated as a result of the running of the profile regeneration program, irradiation intensity values corresponding to each regenerated irradiation profile are set for the respective VCSEL arrays 74 after, for example, completion of the print job.

The profile regeneration process may be such that at step S104 the CPU 20A corrects the previously generated irradiation profile according to a temperature characteristic variation rate.

[Exemplary Embodiment 2 ]

First, the configuration of an inkjet recording apparatus 10A according to a second exemplary embodiment will be described with reference to FIG. 11. Constituent elements in FIG. 11 having the same ones in FIG. 1 are given the same reference symbols as the latter, and descriptions therefor will be omitted.

Figure 11:
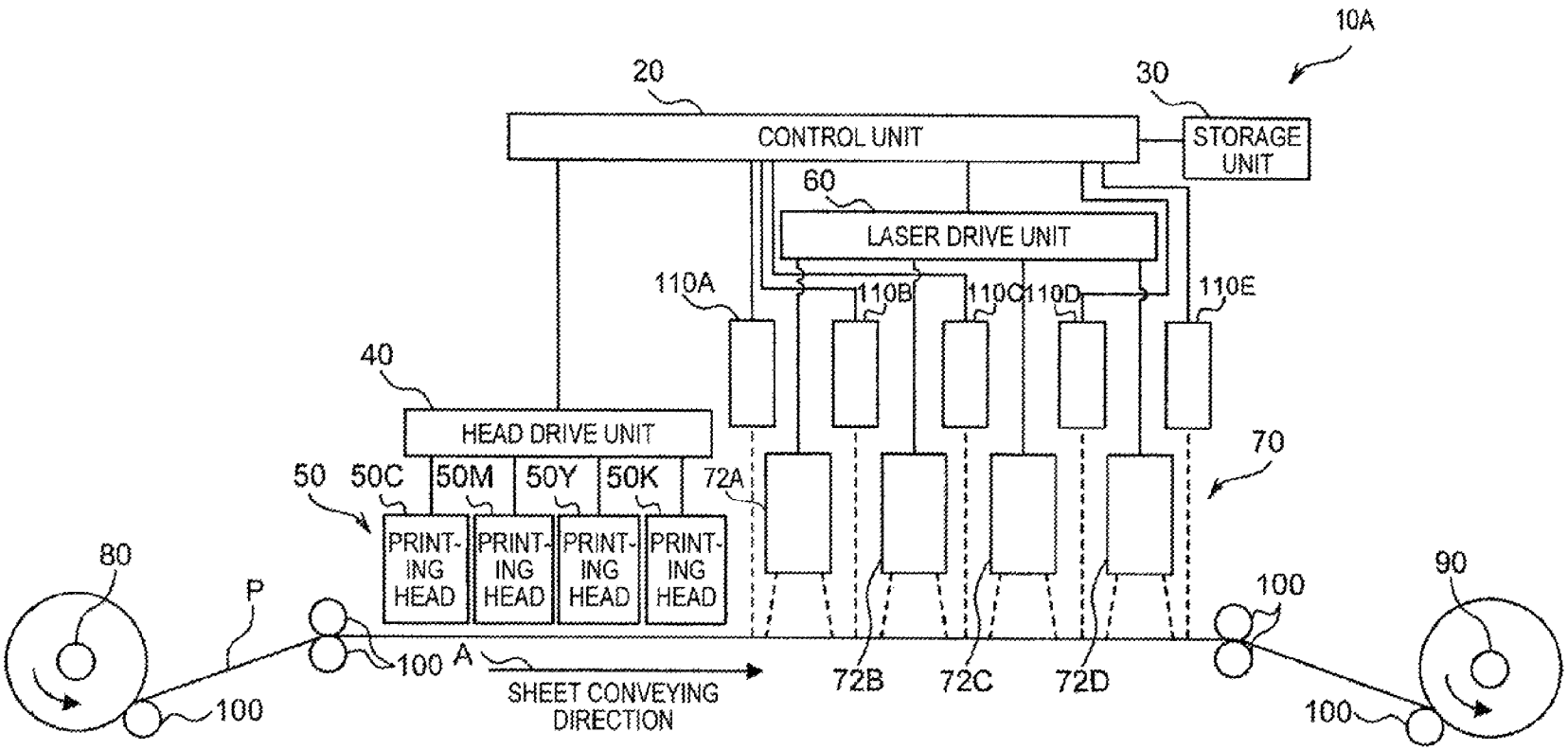
FIG. 11 schematically shows an essential configuration of an inkjet recording apparatus according to a second exemplary embodiment.

As shown in FIG. 11, a laser drying device 70 employed in this exemplary embodiment is equipped with laser drying units 72A-72D which are arranged in this order downstream in the conveying direction. In the following description, when the laser drying units 72A-72D need not be discriminated from each other, the alphabetical suffixes of these symbols will be omitted. The laser drying units 72 are arranged in the conveying direction with predetermined gaps so that their laser light irradiation ranges do not overlap with each other.

Temperature sensors 110A-110E are disposed so as to be opposed to an image forming surface at a position between the printing heads 50 and the laser drying unit 72A, positions between the laser drying units 72, and a position downstream of the laser drying unit 72D. In the following description, when the temperature sensors 110A-110E need not be discriminated from each other, the alphabetical suffixes of these symbols will be omitted. Under the control of the control unit 20, each temperature sensor 110 measures a temperature of inks on a portion, passing it, of a continuous sheet P.

Next, the configuration of the laser drying device 70 will be described in detail with reference to FIG. 12. Constituent elements in FIG. 12 having the same one in FIG. 2 are given the same reference symbols as the latter, and descriptions therefor will be omitted.

Figure 12:
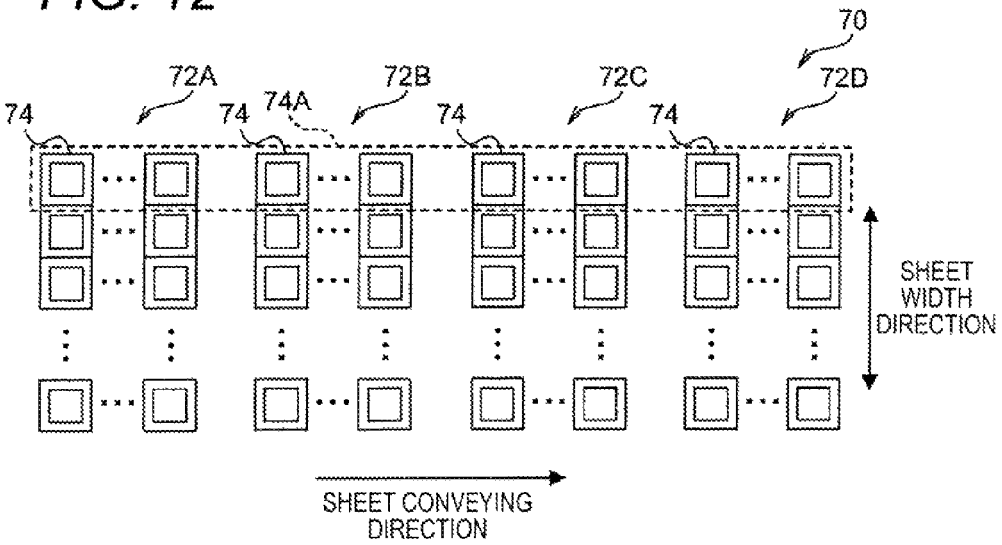
FIG. 12 is a schematic plan view showing an example configuration of a laser drying device used in the second exemplary embodiment.

As shown in FIG. 12, each of the laser drying units 72 employed in the exemplary embodiment is equipped with plural VCSEL arrays 74 that are arranged two-dimensionally, more specifically, in lattice form in the conveying direction and the sheet width direction.

The essential electrical configuration of the inkjet recording apparatus 10A according to this exemplary embodiment is the sane as that of the inkjet recording apparatus 10 according to the first exemplary embodiment and hence will not be described below.

Figure 13:
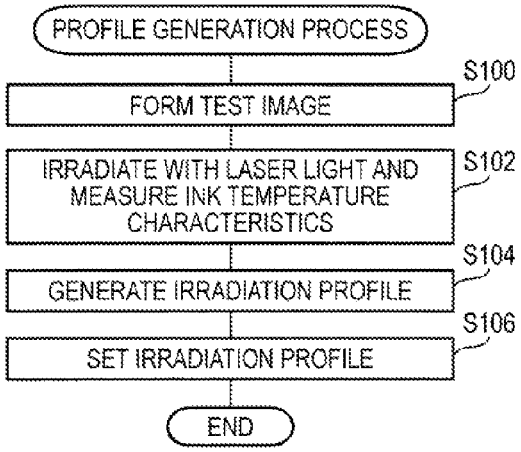
FIG. 13 is a flowchart showing the procedure of a profile regeneration program according to the second exemplary embodiment.

Next, the workings of the inkjet recording apparatus 10A according to the exemplary embodiment will be described. First, a profile generation process according to the exemplary embodiment will be described with reference to FIG. 13. FIG. 13 is a flowchart showing the procedure of a profile generation program that is run by the CPU 20A when an ink type is switched. The profile generation program is installed in the ROM 203 in advance. Steps in FIG. 13 having the same ones in FIG. 5 are given the same step numbers as the latter, and descriptions therefor will be omitted. It goes without saying that the profile generation program may be run with different timing than described below, as in the first exemplary embodiment.

At step S102 shown in FIG. 13, the CPU 20A causes the laser drying device 70 to irradiate a test image with laser light in such a manner that VCSEL array groups 74A in a region corresponding to a test image forming region emit laser light at different irradiation intensities. At the same time, the CPU 20A causes the temperature sensors 110 to measure ink temperatures for each of the unit regions corresponding to the respective different irradiation intensity values, and stores measurement results in the storage unit 30. The CPU 20A generates, as approximated ink temperature characteristics like the ink temperature characteristics shown in FIGS. 4A and 4B, curves of the {(number of temperature sensors 110) −1 }th order in the exemplary embodiment, 4th order) on the basis of the temperatures measured by the temperature sensors 110, and stores them in the storage unit 30.

At step S104, the CPU 20A generates an irradiation profile according to ink temperature increase rates and decrease rates that are obtained from the approximated ink temperature characteristic curves generated at step S102. In the exemplary embodiment, as described above, since the laser light irradiation ranges of the respective laser drying units 72 do not overlap with each other, inks are not irradiated with laser light from the end of laser light irradiation by one laser drying unit 72 to the start of laser light irradiation by the laser drying unit 72 immediately downstream of it. The ink temperature drops in this non-irradiation period. In the exemplary embodiment, a irradiation profile is generated also using an ink temperature decrease rate in such a period.

More specifically, as at step S104 shown in FIG. 5, the CPU 20A calculates rates of increase (i.e., increases per unit time) of ink temperature corresponding to the respective laser light irradiation intensity values. The CPU 20A also calculates a rate of decrease (i.e., a decrease per unit time) of ink temperature after the end of laser light irradiation for a curve in which laser light irradiation ended in the vicinity of a boiling temperature (in the example of FIG. 4A, the curve with the irradiation intensity 1.75 J/cm$^2$) among the ink temperature characteristic curves. The. CPU 20A determines an irradiation intensity with which the ink temperature will not exceed the boiling temperature. On the other hand, the CPU 20A determines, for the laser drying units 72A-72D, on the basis of the calculated increase rate and decrease rate, an irradiation intensity with which the ink temperature will be increased by the some amount as a temperature drop due to absence of laser light irradiation and does not exceed the boiling temperature.

Figure 14:
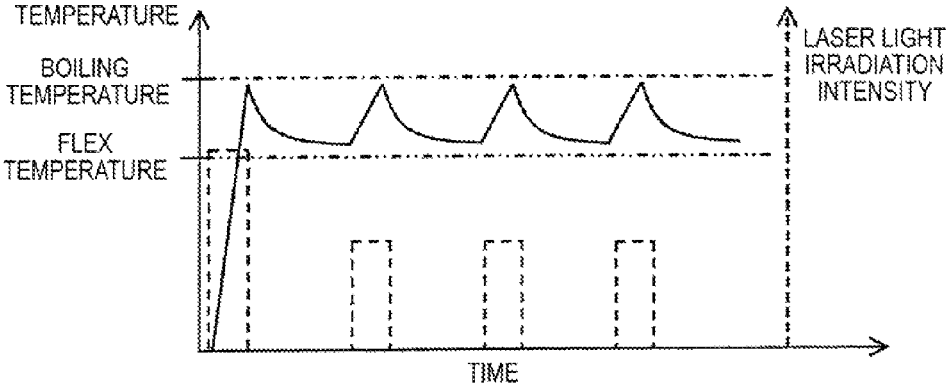
FIG. 14 is a graph showing an example irradiation profile used in the second exemplary embodiment.

Next, referring to FIG. 14, a description will be made of how the temperature of inks varies when the inks are dried using an irradiation profile generated by running the above-described profile generation program. In FIG. 14, the broken lines, which correspond to the right-hand vertical axis, represent laser light irradiation intensity values and the solid-line curve, which corresponds to the left-hand vertical axis, represents a variation of ink temperature. The horizontal axis, of FIG. 14 represents the elapsed time from ejecting of ink droplets. In FIG. 14, the chain line and the two-dot chain line indicate a boiling temperature and a flex temperature, respectively.

As shown in FIG. 14, with an irradiation profile generated according to the exemplary embodiment, inks are irradiated by the laser drying unit 72A with laser light having as large an irradiation intensity as possible that does not cause the ink temperature to reach the boiling temperature. With this irradiation profile, the inks are irradiated by each of the laser drying units 72B-72D with laser light having such an irradiation intensity that the ink temperature will be increased by the same amount as a temperature drop due to absence of laser light irradiation and will not exceed the boiling temperature. As a result, as shown in FIG. 14, the ink temperature varies so as to repeat a cycle that it increases to close to the boiling temperature approximately linearly and then decreases because of absence of laser light irradiation. That is, the ink temperature is kept within a certain range, that is, kept higher than or equal to a flex temperature and lower than the boiling temperature.

In this exemplary embodiment, as in the first exemplary embodiment, it goes without saying that an irradiation profile regeneration process may be executed when the inkjet recording apparatus 10A receives an instruction to carry out a print job for formation of images of plural pages.

Although the two exemplary embodiments of the invention have been described above, the technical scope of the invention is not limited to these exemplary embodiments. A variety of changes and modifications can be made in each of these embodiments without departing from the spirit and scope of the invention, and resulting modes are also included in the technical scope of the invention.

The above-described exemplary embodiments should not be construed as restricting the claimed invention, and not all of the features described in each of those exemplary embodiments are indispensable in solving the problems of the prior art. The above-described exemplary embodiments include inventive concepts at various stages and various inventive concepts can be extracted by combining plural ones of the disclosed constituent elements. Modes obtained by deleting several ones of all the constituent elements of each exemplary embodiment can be extracted as inventive concepts as long as they can provide the intended advantages.

Figure 15:
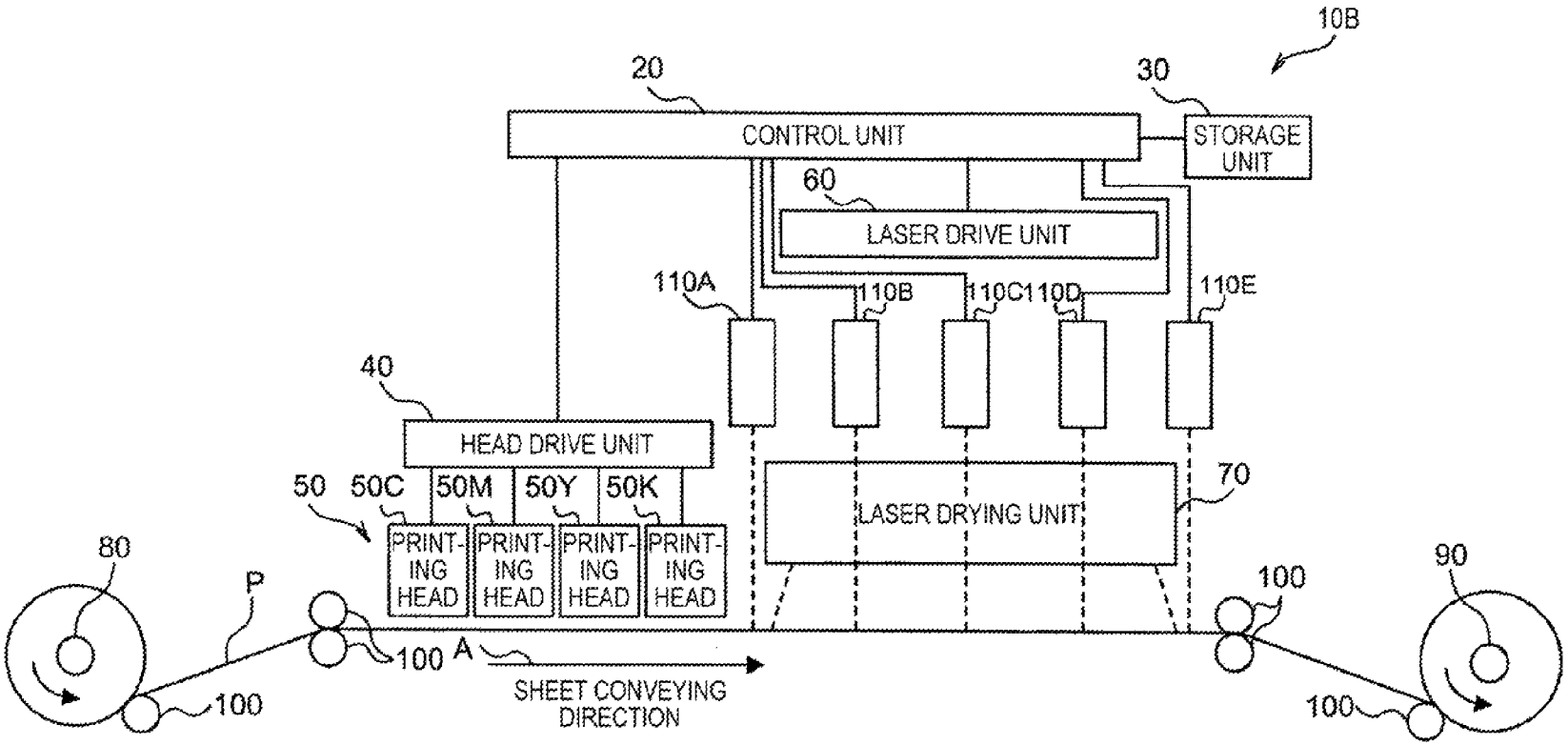
FIG. 15 schematically shows an essential configuration of an inkjet recording apparatus according to a modification.
Figure 16:
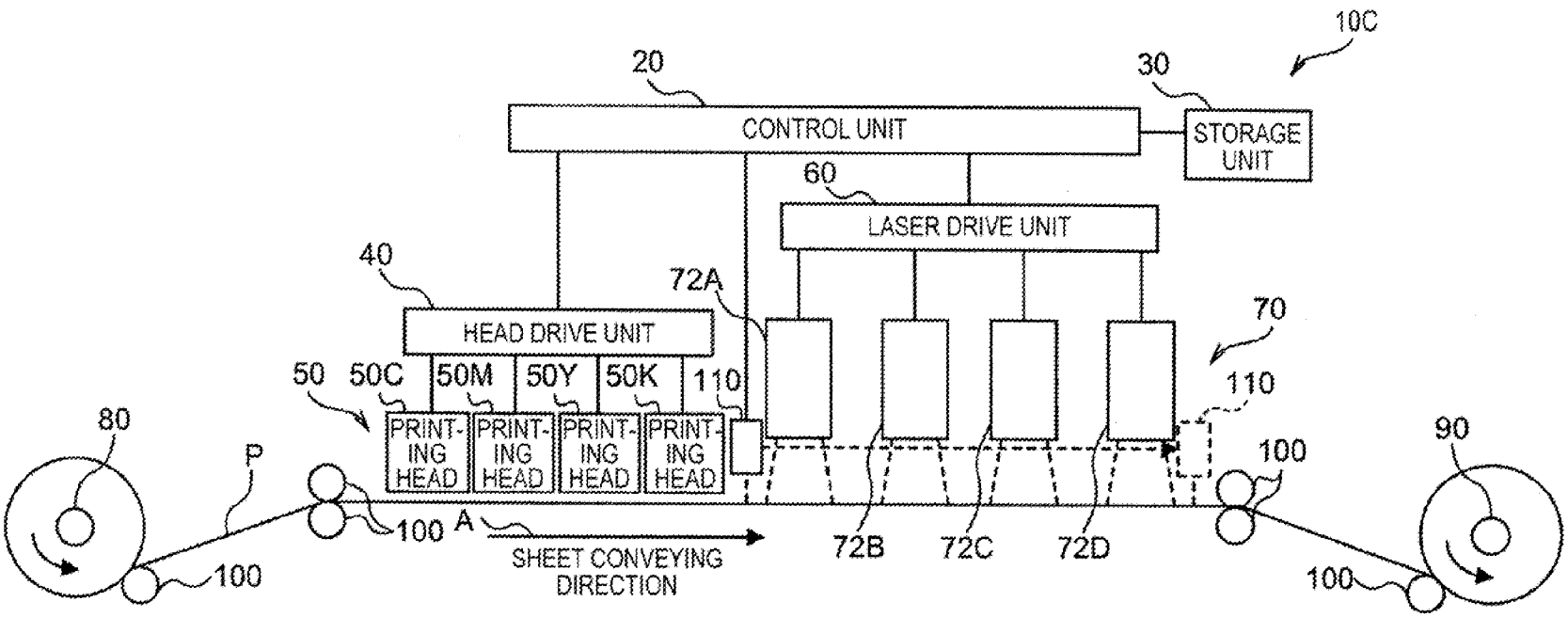
FIG. 16 schematically shows an essential configuration of an inkjet recording apparatus according to another modification.

For example, an inkjet recording apparatus 10B having a configuration shown in FIG. 15 is possible that is obtained in such a manner that in the inkjet recording apparatus 10 according to the first exemplary embodiment the temperature sensor 110 is replaced by the temperature sensors 110 used in the second exemplary embodiment. An inkjet recording apparatus 10C having a configuration shown in FIG. 16 is also possible that is obtained in such a manner that in the inkjet recording apparatus 10A according to the second exemplary embodiment the temperature sensors 110 are replaced by the temperature sensor 110 used in the first exemplary embodiment.

A size, shape, and color of a test image are not restricted to those described in each exemplary embodiment. For example, it goes without saying that another size, shape, or color may be used as long as ink temperature characteristics as described in each exemplary embodiment can also be obtained with it.

Although in each exemplary embodiment an irradiation profile is generated using a test image, the invention is not limited to such a case; an irradiation profile may be generated using a user image.

Although in each exemplary embodiment an irradiation profile is generated using ink temperature characteristics obtaining by shining laser light at plural irradiation intensities, the invention is not limited to such a case. For example, an irradiation profile may be generated using an ink temperature characteristic that is obtained by shining laser light at a single irradiation intensity. For example, where the ink temperature characteristic shown in FIG. 4A that was obtained with an irradiation intensity 4.5 J/cm$^2$ is used, an ink temperature increase rate of the case of the laser light irradiation with the irradiation intensity 4.5 J/cm$^2$ is calculated in the same manner as at step S104 shown in FIG. 5. A time it takes for the ink temperature to reach the boiling temperature from a time when the ink temperature becomes higher than or equal to the flex temperature is calculated on the basis of the calculated increase rate. Then an irradiation intensity with which the ink temperature will be kept in the range that is higher than or equal to the flex temperature and lower than the boiling temperature is calculated on the basis of a ratio between the calculated time and a time from the time when the ink temperature becomes higher than or equal to the flex temperature to a time when the ink temperature reaches the boiling temperature. Finally, the irradiation intensities of VCSEL arrays 74 located upstream of a position corresponding to the time when the ink temperature becomes higher than or equal to the flex temperature are set at 4.5 J/cm$^2$ and the irradiation intensities of VCSEL arrays 74 located downstream of this position are set at the irradiation intensity calculated above.

Although in each exemplary embodiment regenerated irradiation profiles will be used in the next print job, the invention is not limited to such a case. For example, the inkjet recording apparatus 10C shown in FIG. 16 may operate in such a manner that an irradiation profile is generated on the basis of ink temperature characteristics that are measured by the temperature sensor 110 in a region upstream of the laser drying unit 72C in the conveying direction and that the laser light irradiation intensities of the laser drying units 72C and 72D are updated during the execution of the print job using the generated irradiation profile.

Although each exemplary embodiment is directed to the case of using a continuous sheet P, the invention is not limited to such a case; for example, cut sheets of A4, A3, or the like may be used as recording media. The material of a recording medium is not limited to paper; a recording medium made of another material may be used as long as it allows ink to be dried and fixed to it when irradiated with laser light.

Although in each exemplary embodiment various programs are installed in the ROM 20B in advance, the invention is not limited to such a case. For example, various programs may be provided being stored in such a recording medium as a CD-ROM (compact disc-read only memory) or being transmitted over a network.

Although in each exemplary embodiment each step of the profile generation process and the profile regeneration process are implemented by software using a computer, that is, by running the programs, the invention is not limited to such a case. For example, each step of them may be implemented by hardware or a combination of hardware and software.

The configurations of the inkjet recording apparatus 10 (FIGS. 1-3) and the inkjet recording apparatus 10A (FIGS. 11 and 12) according to the exemplary embodiments are just examples. It goes without saying that deletion of unnecessary elements and addition of new elements are possible without departing from the spirit and scope of the invention.

The procedures of the profile generation programs (FIGS. 5 and 13) and the profile regeneration program (FIG. 9) according to the exemplary embodiments are just examples. It goes without saying that deletion of unnecessary steps, addition of new steps, and changing of the order of execution of steps are possible without departing from the spirit and scope of the invention.

The structure of the table (see. FIG. 8) used in the first exemplary embodiment is just an example; it goes without saying that it may be changed without departing from the spirit and scope of the invention.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. A drying device comprising:

a drying unit in which a plurality of laser light sources are arranged two-dimensionally and that dries ink placed on a recording medium as a result of ejecting of ink droplets from an ejecting unit by irradiating the ink with laser light;

a measuring unit that measures a temperature characteristic, in a conveying direction of the recording medium, of the ink placed on the recording medium;

a generation unit that generates, based on the temperature characteristic measured by the measuring unit, a laser light irradiation profile with which the ink temperature will be raised by irradiation with laser light to become higher than or equal to a flex temperature at which the ink temperature starts to flex and then kept in a range that is higher than or equal to the flex temperature and lower than a boiling temperature of the ink; and a control unit that controls the drying unit using the irradiation profile generated by the generation unit.

2. The drying device according to claim 1, wherein the generation unit generates an irradiation profile by determining a laser light irradiation intensity with which the ink temperature does not exceed the boiling temperature based on an ink temperature increase rate in a portion of the temperature characteristic measured by the measuring unit from a start of laser light irradiation to a time when the ink temperature reaches the flex temperature.

3. The drying device according to claim 2, wherein:

the drying unit comprises a plurality of laser drying units that are arranged in the conveying direction so that laser light irradiation ranges of the plurality of laser drying units do not overlap with each other;

the measuring unit measures temperature characteristics of the ink when the ink is irradiated with laser light at different irradiation intensities, respectively; and the generation unit generates an irradiation profile by calculating an ink temperature drop from suspension to a restart of laser light irradiation based on an ink temperature decrease rate of a temperature characteristic measured by the measuring unit with such an irradiation intensity that the ink temperature did not exceed the boiling temperature and determining, based on the calculated ink temperature increase, a laser light irradiation intensity with which the ink temperature will increase by the same amount as the calculated ink temperature drop and will not exceed the boiling temperature.

4. The drying device according to claim 1, wherein the measuring unit measures a temperature characteristic or characteristics while being moved in the conveying direction keeping pace with conveyance of the recording medium.

5. The drying device according to claim 2, wherein the measuring unit measures a temperature characteristic or characteristics while being moved in the conveying direction keeping pace with conveyance of the recording medium.

6. The drying device according to claim 3, wherein the measuring unit measures a temperature characteristic or characteristics while being moved in the conveying direction keeping pace with conveyance of the recording medium.

7. An image forming apparatus comprising:

the drying device according to claim 1;

an ejecting unit that ejects ink droplets to a recording medium; and a conveying mechanism that conveys the recording medium.

8. The image forming apparatus according to claim 7, wherein:

when the image forming apparatus receives an instruction to carry out a job for formation of images of a plurality of pages on the recording medium, the ejecting unit forms a test image in each of regions between adjoining ones of the plurality of pages by ejecting ink droplets to the regions;

the measuring unit measures a temperature characteristic of ink of the test image; and the generation unit generates an irradiation profile again if the temperature characteristic measured by the measuring unit this time is different from a temperature characteristic measured previously.

9. The image forming apparatus according to claim 8, wherein:

the generation unit generates an irradiation profile again based on a temperature characteristic measured by the measuring unit in a region that is upstream of a predetermined set of laser light sources in the conveying direction; and the control unit controls the predetermined set of laser light sources and laser light sources located downstream thereof in the conveying direction using the irradiation profile generated again.

10. A computer readable medium storing a program causing a computer to function as the generation unit and the control unit of the drying device according to claim 1.

* * * * *